US005104367A

United States Patent [19]

Hill

[11] Patent Number: 5,104,367

[45] Date of Patent: Apr. 14, 1992

[54] PINNED ROLLERS AND PROCESS FOR MANUFACTURING FIBRILLATED FILM

[75] Inventor: Michael Hill, Ascot, England

[73] Assignee: Filter Materials Limited, New York, N.Y.

[21] Appl. No.: 617,395

[22] Filed: Nov. 20, 1990

Related U.S. Application Data

[63] Continuation of Ser. No. 231,144, Aug. 10, 1988, abandoned.

[51] Int. Cl.[5] ..... B26F 1/24; B65H 35/08

[52] U.S. Cl. ..... 493/42; 493/338; 493/471; 83/660; 264/154; 264/DIG. 47

[58] Field of Search ..... 493/42, 44, 46, 50, 493/338, 353, 354, 464; 28/DIG. 1; 225/97; 83/660; 264/154, DIG. 47; 425/290

[56] References Cited

U.S. PATENT DOCUMENTS

| | | | |
|---|---|---|---|
| 3,474,611 | 10/1969 | Suzuki et al. | 57/31 |
| 3,494,522 | 2/1970 | Kim et al. | 225/97 |
| 3,495,752 | 2/1970 | Kim et al. | 225/3 |
| 3,496,260 | 2/1970 | Guenther et al. | 264/156 |
| 3,500,517 | 3/1970 | Dekker et al. | 28/1.5 |
| 3,500,627 | 3/1970 | Kim | 57/140 |
| 3,526,349 | 9/1970 | Moro | 225/97 |
| 3,565,308 | 2/1971 | Slack | 225/97 |
| 3,566,735 | 3/1971 | Greene | 83/344 |
| 3,577,724 | 5/1971 | Greene | 57/157 |
| 3,595,454 | 7/1971 | Kalwaites | 225/3 |
| 3,658,221 | 4/1972 | McMeekin et al. | 83/660 |
| 3,726,079 | 4/1973 | Feild et al. | 57/155 |
| 3,739,053 | 6/1973 | Yazawa | 264/154 |
| 3,756,484 | 9/1973 | Guenther | 225/97 |
| 3,787,261 | 1/1974 | Heger et al. | 156/84 |
| 3,801,252 | 4/1974 | Waterhouse | 425/304 |
| 3,835,513 | 9/1974 | Stanley | 28/72.14 |
| 3,880,173 | 4/1975 | Hill | 131/269 |
| 3,883,936 | 5/1975 | Stanley | 28/72.14 |
| 3,927,957 | 12/1975 | Chill et al. | 425/131.1 |
| 3,985,600 | 10/1976 | Blais | 156/229 |
| 3,985,933 | 10/1976 | Mehta et al. | 428/357 |
| 4,129,632 | 12/1978 | Olson et al. | 264/40.1 |
| 4,134,951 | 1/1979 | Dow et al. | 264/147 |

FOREIGN PATENT DOCUMENTS

| | | | |
|---|---|---|---|
| 1087958 | 8/1960 | Fed. Rep. of Germany | 493/42 |
| 1918569 | 10/1970 | Fed. Rep. of Germany . | |
| 1931265 | 12/1970 | Fed. Rep. of Germany . | |
| 1552888 | 12/1968 | France . | |
| 1207733 | 10/1970 | United Kingdom . | |
| 1260957 | 1/1972 | United Kingdom . | |
| 1339496 | 12/1973 | United Kingdom . | |
| 1411561 | 10/1975 | United Kingdom . | |
| 1421324 | 11/1976 | United Kingdom . | |

*Primary Examiner*—Bruce M. Kisliuk
*Assistant Examiner*—Jack Lavinder
*Attorney, Agent, or Firm*—Jeffrey H. Ingerman; John W. Matthews

[57] ABSTRACT

A roller for use in fibrillating oriented films of polyolefin materials having a plurality of pins projecting from the surface of the roller. The pins are distributed in a plurality of rows spaced around the roller surface. The rows each contain about 25 to 34 pins per inch in a space-staggered relationship along two adjacent lines extending along the surface of the roller, either in a linear relationship inclined to a line parallel to the axis or rotation, or in a sinusoidal relationship with adjacent rows being in or out of phase. The roller is rotated and the film is advanced over the rotating roller surface for an arc length of contact of about 30 to 37 degrees to fibrillate the film. The ratio of the surface speed of the roller to the advancing film are controlled to a ratio between from about 1.8:1 to about 2.2:1.

32 Claims, 4 Drawing Sheets

PINNED ROLLERS AND PROCESS FOR MANUFACTURING FIBRILLATED FILM

This is a continuation of application Ser. No. 231,144, filed Aug. 10, 1988 now abandoned, entitled IMPROVED PINNED ROLLERS AND PROCESS FOR MANUFACTURING FIBRILATED FILM, in the name of Michael Hill.

BACKGROUND OF THE INVENTION

This invention relates to the improved manufacture of fibrillated material webs, and particularly to pinned rollers suitable for making fibrillated film from polyolefin base resins for filter material. More particularly, this invention reates to an improvement on the methods and apparatus of U.S. Pat. No. 3,880,173, the disclosure of which is hereby incorporated by reference.

It is known to fibrillate a poleyolefin film to produce a film having an interconnected fibrous network. The process involves stretching the film to orient the polymer chain or crystal structure to be aligned in the direction of the advancement of the film, and subjecting the oriented film to impaction by various means to fracture the film and create the fibrous network. Orientation is typically accomplished by stretching the web using rollers that are rotating at different surface speeds. The means to impact the oriented films may include fluids such as water or gas jets, blades, pins, toothed projections, laser beams, twisting of the orientated films, embossing of the orientated films, and embossing of the films prior to orientation.

Prior U.S. Pat. No. 3,880,173 and corresponding U.K. Patent 1,442,593 refer to obtaining fibrillated polyolefin film materials for filter materials as an alternative to cellulose acetate filter materials, specifically, but not exclusively, for filtering tobacco smoke of smoking articles. The polyolefin materials described include polypropylene, polyethylene, or a mixture thereof, or a copolymer of propylene and ethylene, and optionally may include finely divided whitener such as titanium dioxide to facilitate the production of narrow fibrous strands.

In accordance with the fibrillation process described in U.S. Pat. No. 3,880,173, the polyolefin stock materials are heated, mixed, and extruded into a thin film. The film is blown to form thinner films which are flattened, slit lengthwise, and superimposed to form multiple thin film layers of about 10–15 $\mu$ thick. The multiple layers are passed through an oven at elevated temperatures while being stretched over differential speed rollers to orient the molecular structure of the films in the longitudinal direction. The oriented film is then passed over a rotating roller having a plurality of pins projecting therefrom.

The pinned roller rotates at a surface speed that is faster than the linear speed of the web. The pins projecting from the roller thus contact and fracture the relatively slower moving superimposed layers, thereby producing an interconnected web of fibers having free ends that is the fibrillated material. The fibrillated material is then passed into a stuffer box crimper device in a conventional manner to create crimps in the fibrillated film, thus forming a polyolefin tow. The crimps include primary crimps, the creation of a wavy configuration in the fibers caused by rapid deceleration of the advancing fibers, and a secondary crimp, corresponding to a wrinkling effect when the fibers collapse and fold in on themselves.

For forming filters for smoking articles, the secondary crimp is typically removed from the polyolefin tow, for example, by tension, and the tow is formed into a bloomed flocculent mass which is then formed into a filter rod by using a conventional filter rod making machine. A binder agent, e.g., vinyl acetate, may be included in the tow for forming filter rods in a known manner.

One problem with the known fibrillated polyolefin materials is that, although they may have filtering characteristics comparable to cellulose acetate filters, they do not have the low mass that is required to provide a cost advantage. Another problem is that known tows do not have a consistent, quality fibrous network that allows for use in a filter tow material where relatively short lengths of tow are used. Another problem is that the known apparatus for producing the fibrillated network consumes a substantial amount of power and generates a substantial amount of noise to create the interconnected fiber network.

Further, notwithstanding years of development efforts, there is no commercial use of a filter for smoking articles comprising a fibrillated polyolefin material that provides the advantages and benefits associated with conventional cellulos acetate filter materials used in smoking articles, and particularly, tobacco-containing cigarettes.

Accordingly, there is a continuing need for apparatus and methods for fibrillating polyolefin resin based materials to produce a fibrillated tow material having a consistent fibrous strand network that is adaptable for use as a filter tow material, particularly for filtering tobacco smoke, that is more effective, and easier and cheaper to manufacture and form into filters, than cellulose acetate.

SUMMARY OF THE INVENTION

It is an object of this invention to provide apparatus and methods for producing an improved fibrillated polyolefin film network that can be adapted for use as a filter tow material, particularly for use in tobbaco-containing smoking articles, having improved filtration per weight of fibrillated material.

It is another object of the invention to provide an improved apparatus and method for impacting an oriented polyolefin material to form a fibrillated film network having improved uniformity.

In accordance with this invention, there is provided an improved roller having pins projecting from the surface ("pinned roller") and a method of using such pinned rollers for impacting advancing oriented polyolefin film materials to fracture the film into a network of fibrillated strands. Broadly, the invention concerns rollers having a plurality of substantially uniformly dimensioned pins distributed around the roller surface in a defined pattern, which pins project from the roller surface at an angle within a range of angles relative to a tangent, and a method of using such pinned rollers to impact the advancing film in an advantageous manner to result in a fibrillated material having substantially improved uniformity, more randomly distributed free ends, and surprisingly improved filtration characteristics per unit weight when formed into filter materials.

It has been discovered that surprisingly improved fiber networks can be obtained by using a pinned roller having pins projecting from the surface in particular patterns spaced about the pin surface, at an angle in a range of from about 40 to about 75 degrees relative to the tangent of the roller directed opposite to the rotation of the roller, and at a pin density of from about 15 to about 100 pins per inch, the pins being from about 0.2 to about 0.8 mm in diameter.

The pin patterns of the present invention include a plurality of rows of pins, where each row has pins arranged in a space-staggered relationship, i.e., staggered along a pair of parallel lines tending across the roller surface. The double rows of pins are preferably equidistantly spaced about the circumference of the roller surface to present a consistent pattern. In the preferred embodiment, there are 90 double rows spaced about a roller having a diameter of about 190 mm and a pin projection length of about 1.0 mm, the pin projection length being measured in a plane perpendicular to a tangent to the roll surface from the pin tip. The density of pins in each row is from about 25 to about 34 pins per inch (ppi) more preferably about 25 ppi.

In one embodiment, the rows of pins extend across the roller surface on lines inclined to lines parallel to the roller axis with immediately adjacent rows being oppositely inclined. In another embodiment the rows may extend on lines parallel to the axis of the roller, but having a sinusoidal pattern, as contrasted with a linear pattern, with immediately adjacent, spaced apart, sinusoidal rows being either arranged in phase or out of phase across the roll, the waveforms having a wavelength of from about 15 to about 40 mm and an amplitude of from about 2.0 to about 6.0 mm.

It also has been discovered that the advantageous pin patterns provide surprisingly improved fibrillated materials when the oriented, unfibrillated film is placed in contact with the pinned roller for an arc of from about 20 degrees to about 45 degrees, and where the relative linear speeds of the roller surface and the advancing film, known as the fibrillation ratio, is in a range of from about 1.6:1 to about 3.4:1, the fibrillation ratio being defined by the following expression:

$$\text{Fibrillation Ratio} = \frac{\text{Linear Speed Of Roller (m/min)}}{\text{Linear Speed Of Unfibrillated Film Passing Across Roller (m/min)}}.$$

The improved nature of the resultant fibrillated material, as it is particularly useful for filter materials, is observed from the improved Tow Yields for fibrillated polyolefin materials made by the present invention that are formed into filter lengths using conventional filter rod making equipment such as that used for forming cellulose acetate tow into filter materials. Tow Yields are obtained from the following expression:

$$\text{Tow Yield} = \frac{\text{Pressure drop (mm } WG)}{\text{Net Weight of Fiber in rod (mg)}} \times 100\%.$$

The Net Weight is measured in units of milligrams for a given length of filter rod. The pressure drop is measured in millimeters of Water Gauge at an airflow of 1,050 ml per minute through the net weight of rod. Higher Tow Yields correspond to more randomly dispersed free ends, and better filtration capacity for the fibrous strand network per net weight, and hence more efficient use of the polyolefin materials.

Advantageously, the present invention presents pin patterns that result in a roller that can be more uniformly driven by a motor when contacting an advancing unfibrillated film. The motor also consumes less power and results in lower amounts of noise than prior known pinned rollers. These advantages are believed to be a result of the programmed, sequential manner in which the staggered pin patterns of the present invention contact the arc length of the advancing oriented, unfibrillated film.

BRIEF DESCRIPTION OF THE DRAWINGS

The above and other objects and advantages of the invention will be apparent upon consideration of the following detailed description, taken in consideration with the accompanying drawings, in which like reference characters refer to like parts throughout, and in which.

DETAILED DESCRIPTION OF THE INVENTION

Figure 1:
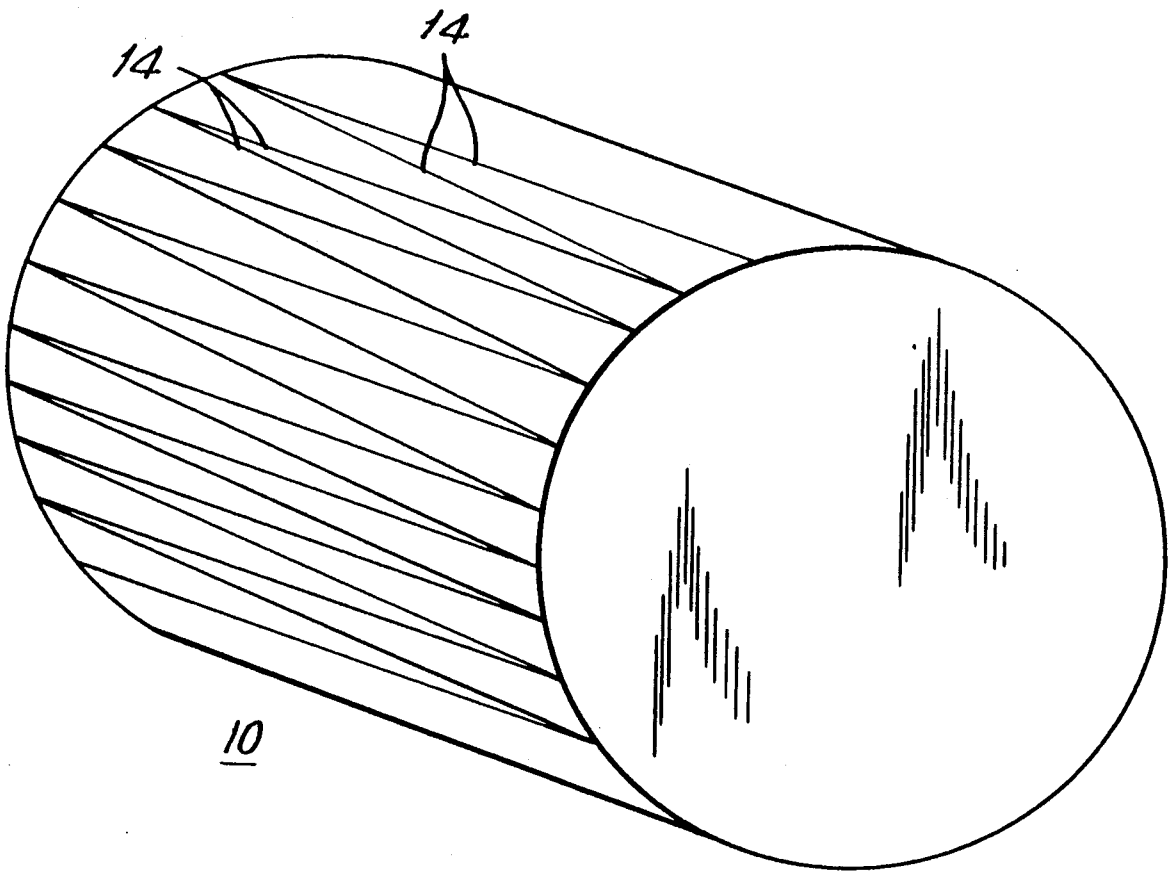
FIG. 1 is an elevated perspective view of a pinned roller of the present invention.

As shown in FIGS. 1-5, illustrative embodiments of this invention include pinned roller 10 adapted for contacting an advancing film of unfibrillated material 20 over an arc length of the roller surface 12, impacting film 20 thereby fracturing the material to form fibrillated film 22.

Referring to FIG. 1, roller 10 is about 190 mm in diameter and about 115 mm long. Approximately 100 mm of the surface width, a width sufficient to contact the entire width of the advancing film of about 50 to 90 mm, contains pins 16. Pins 16 are spaced in staggered relationships in rows 14 of parallel pairs of lines **15*a* and 15*b* extending across the face of roller 10 on a line inclined to the axis of roller 10**, arranged so that immediately adjacent rows are oppositely inclined, presenting a chevron configuration.

In FIG. 1, only rows 14 are shown to represent pins 16 being distributed in staggered relationship along two parallel lines 15. The pattern repeats itself around the surface of roller 10, and, for a roller about 190 mm in diameter, there are preferably about 90 double rows equally spaced apart, for a total of 180 lines of pins 16.

Figure 2:
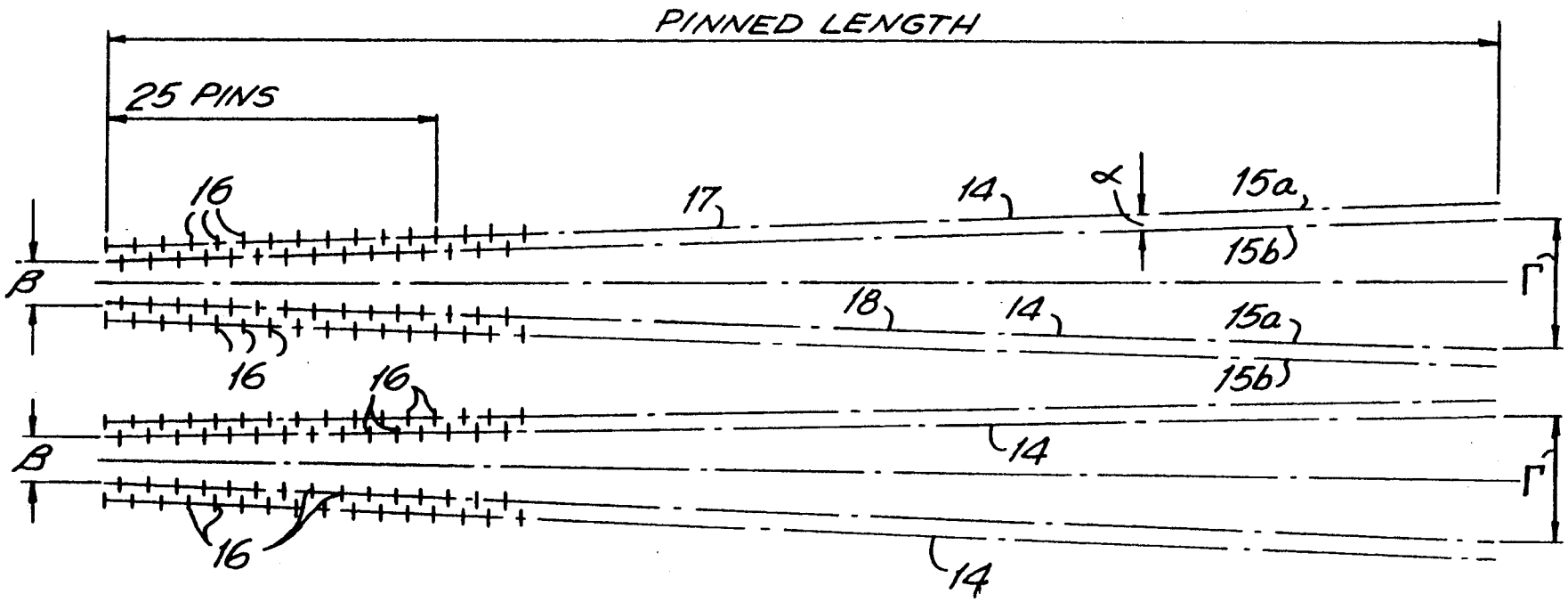
FIG. 2 is a front partial view the roller of FIG. 1.

As shown in detail in FIG. 2, the centers of the two parallel lines **15*a* and 15*b*, corresponding to the two parallel lines of pins 16, are spaced apart a distance a of about 0.05 inches (1.27 mm). The distance B between the oppositely inclined rows 17 and 18 is about 0.1 inches (2.54 mm) at the ends closest together and distance 2 about 0.375 inches (9.53 mm) at the ends that are further apart. The chevron pattern is such that the point of intersection of the oppositely inclined rows would occur off roller surface 12, forming an angle of about 4.0** degrees.

Figure 4:
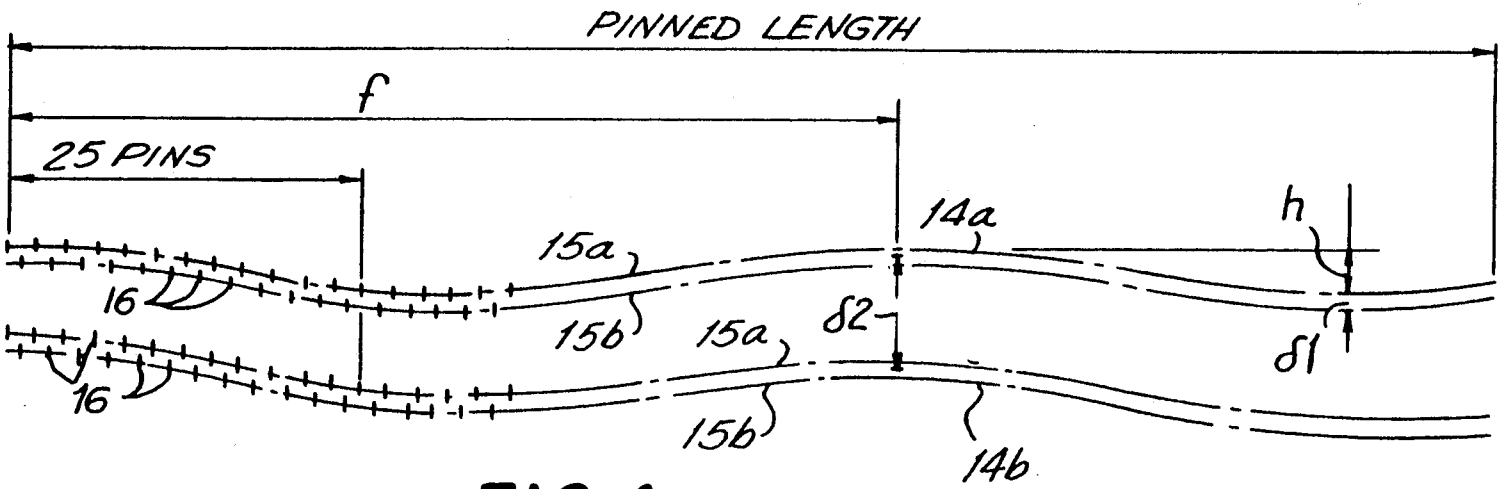
FIG. 4 is a front view of a second embodiment of the roller of the present invention.
Figure 5:
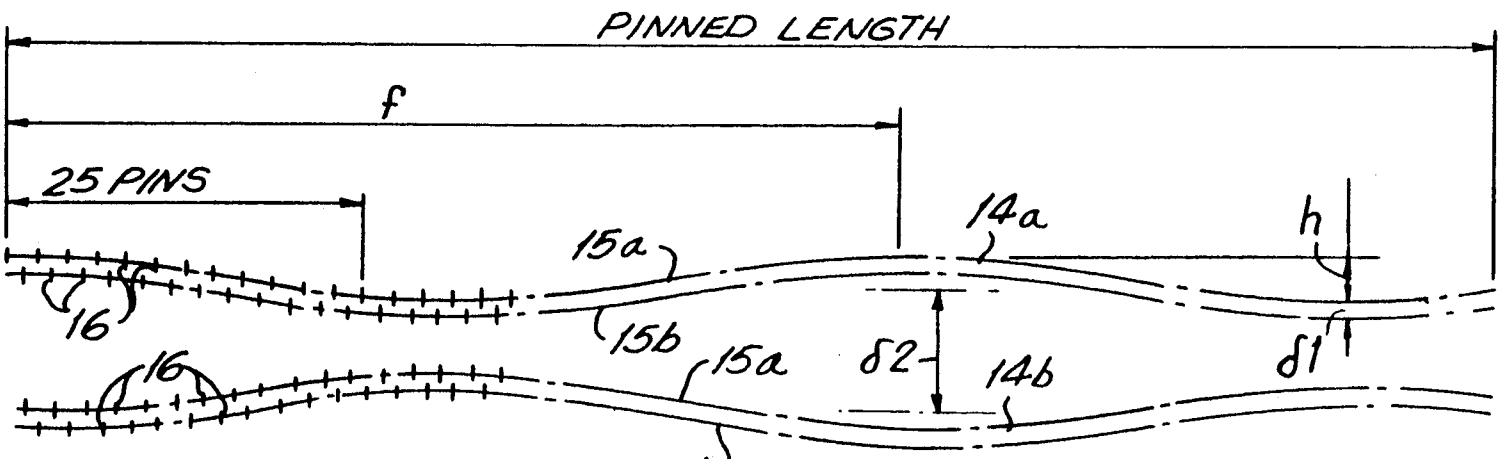
FIG. 5 is a front partial view of a third embodiment of the roller of the present invention.

In FIGS. 2, 4, and 5, the centers of the parallel lines 15 are indicated by solid lines, and individual pins 16 are represented by perpendicular dashes. In, one embodiment, the pin density is about 25 pins per inch, distributed in a staggered relationship between the two parallel lines.

Referring to FIG. 4, an alternate embodiment of a pin pattern is shown. In this embodiment, the rows 14 of pins 16 are arranged in a sinusoidal pattern across a line parallel to the axis of roller 12, with immediately adjacent rows of pins also being in a sinusoidal pattern in phase. A frequency f of about 1.12 inches (28.45 mm) and an amplitude of 0.125 inches (3.175 mm) are used. In this embodiment, the distance between the parallel sinusoidal line centers 15*a* and 15*b* is about 0.05 inches (1.27 mm), and the row pin density is about 25 pins per inch. The distance 82 between adjacent rows 14*a* and 14*b* is about 6.63 mm measured from corresponding zero amplitude to zero amplitude locations around the circumferential surface of the rolls.

Referring to FIG. 5, an second alternate embodiment of a sinusoidal pin pattern is shown. In this embodiment, the immediately adjacent parallel rows 14 of pins 16 are arranged 180° out of phase, having a frequency f of about 1.12 inches (28.45 mm) and an amplitude h of 0.125 inches (3.175 mm). The distance 81 between the parallel sinusoidal line centers 15*a* and 15*b* in each pair of staggered rows 14 of pins 16 is about 0.05 inches (1.27 mm), and the pin density is about 25 pins per inch. The distance 2 between immediately adjacent rows 14*a* and 14*b* is about 6.63 mm measured from corresponding zero amplitude to zero amplitude locations around the circumferential surface of the rolls.

Figures 3, 6:
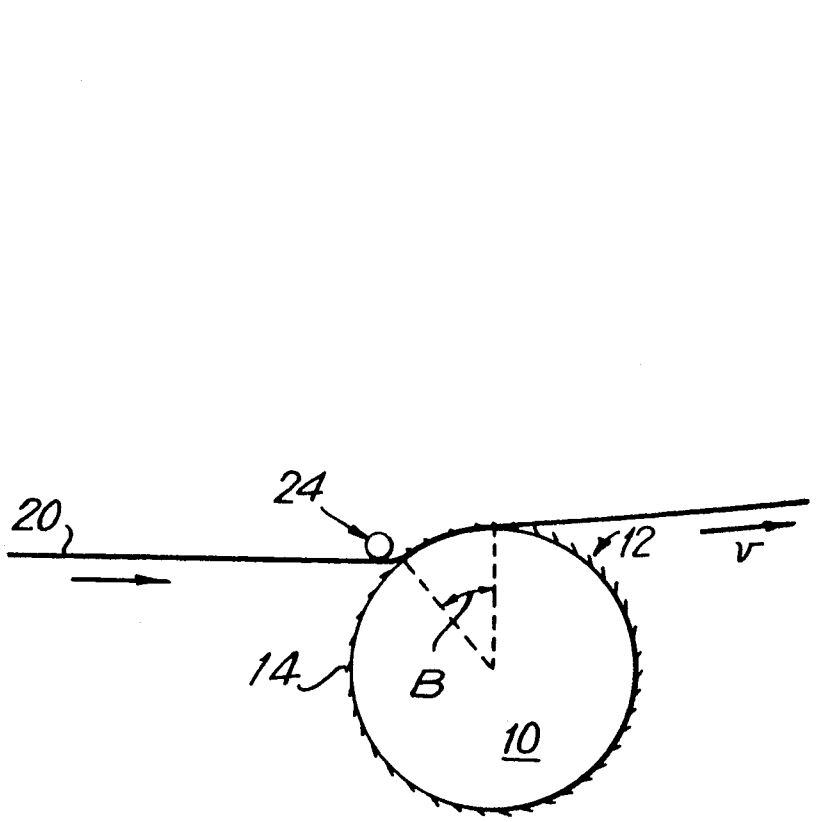
FIG. 3 is an enlarged side sectional view taken along line 3—3 of FIG. 2.
FIG. 6 is a schematic illustration of a roller of the present invention contacting a polyolefin film in accordance with the present invention.

Referring to FIG. 3, pins 16 protrude from surface 12 at an angle of approximately 60° relative to the tangent to roller 10 in the opposite direction to that of the rotation of the roller, as designated by angle A. The length p of projection of pins 16 is approximately 1.0 mm measured perpendicular to a tangent to the roll surface to the pin tip and the pins have a diameter of approximately 0.483 mm.

Referring to FIG. 6, roller 10 is adapted for inclusion in conventional apparatus for fibrillating advancing films of oriented material. Unfibrillated and oriented film 20 is advanced at a selected rate of speed, for example, a rate in a range from about 120 to about 250 meters per minute. Roller 10 is rotated in the same direction as film 20, but at a faster rate so that pins 16 rake along film 20, thereby causing pins 16 to fracture film 20 to form fibrillated film 22. Preferred fibrillation ratios are in the range of from about 1.2 to about 2.8, more preferably about 1.8 to about 2.2.

Film 20 is in contact with roller 10 only for a selected arc length that is controlled to be within a range of from about 20 to about 45 degrees, preferably about 37 degrees. Guide roller 24 may be used to control the amount of arc length of contact and the tension of film 20. Film 20 is to held against roller 10 with enough tension so that it will not ride on top of pins 16, and at least some portions of the film will contact surface 12 of roller 10 as the fibrous network is created. Typical amounts of tension necessary to accomplish this are in a range from about 800 to about 1000 pounds (350 to about 450 kgf).

The method and apparatus of the present invention are further described in connection with the following examples.

EXAMPLES

Each of following examples describe the production of fibrillated polyolefin materials in accordance with the present invention. The polyolefin films were prepared from following blend:

92% polyproplyene homopolymer, melt index 1.8 (230° C., 2.16 Kgf);

7% low density polyethylene, melt index 1.0 (190° C., 2.16 Kgf); and

1% polypropylene (of the same type as above) masterbatch, containing 25% titanium dioxide (rutile grade, fine crystel structure, micronized grade).

These materials were mixed and extruded using a known blown film technique to produce a film of 35 $\mu$ thickness. This film was then slit into six portions of substantially equal width, stacked, and oriented in a longitudinal direction with a stretch ratio of 8:1 to produce films of 12.4 $\mu$ thickness and a width in the range of from about 50 to about 80 mm dependent upon the two denier. The oriented films were then passed around an arc of the periphery of a pinned fibrillating roller in accordance with the present invention, and passed into a stuffer box texturizing operation for crimping the fibrillated film in a conventional manner.

The processing parameters for advancing the film, contacting the film with the pinned roller, the pinned roller characteristics, and the results of the evaluation of the fibrillated material after it has been crimped are set forth in Table I. In each example, the pinned roller used had a diameter of 190 mm at the roller surface, and the angle of rake of the pins was 60 degrees (relative to the tangent). There were 180 lines of pins in pairs to form 90 double rows of pins in a space-staggered relationship and the pin diameter was 0.4826 mm.

The fibrillated material was then formed into a filter rod using conventional filter rod forming apparatus, for example, model KDF-2 manufactured by Hauni Werke Korber & Co., Hamburg, Germany, wherein the tow is formed into a bloomed flocculent mass having the identified crimp characteristics, and processed by the filter making apparatus into a filter rod having a circumference of 24.55 mm and a length of 66 mm.

In the examples, three different pinned rollers were used which are described by reference to the drawings: FIG. 2 for oppositely inclined rows; FIG. 4 for sinusoidal rows in phase; and FIG. 5 for sinusoidal rows out of phase. It is to be understood that the identified pattern is repeated about the roller surface, notwithstanding that FIGS. 2, 4 or 5 may present only partial views.

TABLE I

| | PROCESSING PARAMETERS | | | | | | |
|---|---|---|---|---|---|---|---|
| Parameter | Ex. 1 | Ex. 2 | Ex. 3 | Ex. 4 | Ex. 5 | Ex. 6 | Ex. 7 |
| Pin Configuration | FIG. 2 | FIG. 4 | FIG. 2 | FIG. 2 | FIG. 5 | FIG. 2 | FIG. 2 |
| Pin density (ppi) | 25 | 25 | 34 | 34 | 25 | 25 | 25 |
| Pin projection (mm) | 1 | 1 | 1 | 2 | 1 | 1 | 1 |
| Arc of contact of film (degrees) | 37 | 37 | 37 | 30 | 37 | 30 | 37 |
| Film input speed (m/min) | 144 | 144 | 144 | 144 | 144 | 144 | 144 |
| Surface Speed of | 316 | 260 | 260 | 260 | 288 | 316 | 202 |

TABLE I-continued

| Parameter | PROCESSING PARAMETERS Ex. 1 | Ex. 2 | Ex. 3 | Ex. 4 | Ex. 5 | Ex. 6 | Ex. 7 |
|---|---|---|---|---|---|---|---|
| roller (m/min) | | | | | | | |
| Fibrillation Ratio | 2.2:1 | 1.8:1 | 1.8:1 | 1.8:1 | 2.0:1 | 2.2:1 | 1.4:1 |
| Denier | 38,000 | 32,000 | 32,000 | 32,000 | 40,000 | 38,000 | 38,000 |
| Crimps | 41 | 31.1 | 29.4 | 32.6 | 41.95 | 36.5 | 50.5 |
| Freq. cpi | | | | | | | |
| Amplitude (μ) | 396 | 388 | 420 | 368 | 368 | 332 | 312 |

The results of the evaluation of the filter material constructed from the fibrillated material of the examples are set forth in Table II. The low yield and high yield values respectively correspond to the minimum point and the maximum point on the capability curve, which curve compares relative pressure drop for changes in the net weight of two material in a uniformly dimensioned filter rod. All of these examples provided a tow yield that reflected a significant improvement over the fibrillated polyolefin filter rods obtained by prior known methods and apparatus and over conventional cellulose acetate filters which prior known materials have yields of from about 35% to about 72% for cellulose acetate.

TABLE II

| Parameter | COMPARATIVE YIELDS Ex. 1 | Ex. 2 | Ex. 3 | Ex. 4 | Ex. 5 | Ex. 6 | Ex. 7 |
|---|---|---|---|---|---|---|---|
| LOW YIELD | | | | | | | |
| Net wt. of rod (mg) | 287 | 256 | 261 | 245 | 316 | 316 | |
| Pressure drop (mmWG) | 186 | 150 | 158 | 174 | 230 | 233 | |
| Yield (%) | 65 | 59 | 61 | 71 | 73 | 74 | |
| HIGH YIELD | | | | | | | |
| Net wt. of rod (mg) | 326 | 294 | 295 | 287 | 372 | 381 | |
| Pressure drop (mmWG) | 247 | 194 | 201 | 232 | 370 | 281 | |
| Yield (%) | 76 | 66 | 68 | 81 | 89 | 80 | |

It was noted that the drive current for the roller having a sinusoidal pin distribution (Example 2) was more uniform and of a constant nature than the drive curren for the roller having oppositely inclined rows (Example 1). This indicates a more uniform fibrillation may be achieved by using sinusoidally pinned fibrillating rolls. Examination of the fibrillated tow band produced by Examples 1 and 2 along their longitudinal axes revealed fewer unfibrillated strips, i.e., areas where pin penetration of the films had not occured, in Example 2 as compared to Example 1. This confirms the improved fibrillation.

Considering the effect of changes in processing parameters on pinned rollers having oppositely inclined rows, it is found that higher yield tows may be produced.

Considering the effects of replacing a roller having oppositely inclined rollers with a roller having sinusoidal rows in phase, it is found that higher yield tows may be produced at low power consumption and lower noise levels.

Considering the effects of replacing a roller having oppositely inclined rollers with a roller having sinusoidal rows out of phase, it is found that higher yield tows may be produced.

Considering the effects of sinusoidal pin patterns in and out of phase, it is found that higher yield tows may be produced with the advantage of lower power consumption and noise levels using in phase sinusoidal pin patterns.

One skilled in the art will appreciate that the present invention can be practiced by other than the described embodiments, which are presented for purposes of illustration and not of limitation, and the present invention is limited only by the claims which follow.

I claim:

1. Apparatus for use in fibrillating polyolefin web materials comprising:

a roller having a cylindrical surface and adapted for rotation about its axis in a first direction;

a plurality of pins projecting from the cylindrical surface of the roller at an angle of from about 20 to about 80 degrees relative to a tangent of the roller directed opposite to said first diretion, each pin having a pin projection length in a range of from about 0.5 to about 2.0 mm and a diameter of from about 0.2 to about 0.8 mm, said plurality of pins being arranged in a pattern comprising a plurality of double rows spaced apart around the cylindrical surface, each double row having the pins distributed in a space staggered relationship along a pair of adjacent lines extending across the surface of said roller, wherein the adjacent pairs of lines of a double row are spaced a distance apart that is in the range of from 19% to 21% of the average distance between adjacent double rows.

2. The apparatus of claim 1 wherein said double rows of pins are substantially equidistantly spaced about the cylindrical surface of said roller.

3. The apparatus of claim 2 wherein said adjacent pairs of lines are substantially linear and wherein said pluraity of double rows spaced apart further comprise double rows extending across the roller surface on a line inclined to a line parallel to the roller axis with immediately adjacent double rows being oppositely inclined.

4. The apparatus of claim 3 wherein said immediately adjacent oppositely inclined double rows are spaced apart from 2.0 mm at their closest point and about 12.0 mm at their furthest point.

5. The apparatus of claim 2 wherein said adjacent pairs of lines are substantially sinusoidal.

6. The apparatus of claim 5 wherein said sinusoidal lines have a wavelength of from about 20 to about 80 mm and an amplitude of from about 0.1 to about 4.0 mm.

7. The apparatus of claim 6 wherein said sinusoidal lines have a wavelength of approximately 28.45 mm and an amplitude of approximately 3.175 mm.

8. The apparatus of claim 5 wherein the immediately adjacent sinusoidal rows are out of phase.

9. The apparatus of claim 8 wherein the immediately adjacent double rows are 180 degrees out of phase.

10. The apparatus of claim 1 wherein said roller has a diameter of approximately 190 mm, and said plurality of double rows comprises 90 rows.

11. The apparatus of claim 10 wherein said adjacent parallel lines of a double row are spaced apart approximately 1.27 mm.

12. The apparatus of claim 1 wherein said pins project from said roller surface at an ange of 60 degrees, having a diameter of about 0.483 mm and a pin projection length of about 1.0 mm.

13. Apparatus for use in fibrillating an oriented polyolefin film comprising:

a roller having a cylindrical surface and adapted for rotation about its axis in a first direction;

a plurality of pins projecting from the cylindrical surface of the roller at sn angle of from about 20 to about 80 degrees relative to a tangent of the roller directed opposite tos aid first direction, each pin having a pin projection length in a range of from about 0.5 to about 2.0 mm and diameter of from about 0.2 to about 0.8 mm, said plurality of pins being arranged in a pattern comprising a plurality of double rows spaced apart around the cylindrical surface, each double row having the pins distributed in a space staggered relationship along a pair of adjacent lines extending across the surface of said roller, wherein the adjacent pairs of lines of a double row are spaced a distance apart that is in the range of from 19% to 21% of the average distance between adjacent double rows;

means for advancing the oriented film at a first speed so that said film will contact said roller over an arc length of from about 20 to about 45 degrees of the roller surface; and means for rotating said roller about its axis so that the ratio of the surface linear speed of the roller to the first speed of the film is from about 1.8:1 to about 2.2:1.

14. The apparatus of claim 13 wherein said double rows of pins are substantially equidistantly spaced about the cylindrical surface of said roller.

15. The apparatus of claim 14 wherein said adjacent pairs of lines are substantially sinusoidal.

16. The apparatus of claim 15 wherein said sinusoidal lines have a wavelength of from about 20 to about 80 mm and an amplitude of from about 0.1 to about 4.0 mm.

17. The apparatus of claim 16 wherein said sinusoidal lines have a wavelength of approximately 28.65 mm and an amplitude of approximately 3.175 mm.

18. The apparatus of claim 17 wherein the immediately adjacent sinusoidal double rows are out of phase.

19. The apparatus of claim 18 wherein the immediately adjacent double rows are 180 degrees out of phase.

20. The apparatus of claim 16 wherein said pins project from said roller surface at an angle of 60 degrees, having a diameter of about 0.483 mm and a pin projection length of about 1.0 mm.

21. The apparatus of claim 20 wherein the pin density is about 50 pins per inch, the arc length of contact is about 37 degrees, and the fibrillation ratio is about 1.8:1.

22. The apparatus of claim 20 wherein the pin density is about 50 pins per inch, the arc length of contact is about 37 degrees, and the fibrillation ratio is about 2.0:1, and wherein immediately adjacent sinusoidal double rows are 180 degrees out of phase.

23. The apparatus of claim 13 wherein said adjacent pairs of lines are substantially linear and parallel and wherein said plurality of rows spaced apart further comprise double rows extending across the roller surface on a line inclined to a line parallel to the roller axis with immediately adjacent double rows being oppositely inclined.

24. The apparatus of claim 23 wherein said immediately adjacent oppositely inclined double rows are spaced apart about 2.54 mm at their closest point and about 9.53 mm at their furthest point.

25. The apparatus of claim 24 wherein said pins project from said roller surface at an angle of 60 degrees, having a diameter of about 0.483 mm and a pin projection length of about 1.0 mm.

26. The apparatus of claim 25 wherein the pin density is about 50 pins per inch, the arc length of contact is about 37 degrees, and the fibrillation ratio is about 2.2:1.

27. The apparatus of claim 25 wherein the pin density is about 68 pins per inch, the arc of contact is about 37 degrees, and the fibrillation ratio is about 1.8:1.

28. The apparatus of claim 25 wherein the pin density is about 68 pins per inch, the arc length of contact is about 30 degrees, and the fibrillation ratio is about 1.8:1.

29. The apparatus of claim 25 wherein the pin density is about 50 pins per inch, the arc length of contact is about 30 degrees, and the filbrillation ratio is about 2.2:1.

30. The apparatus of claim 13 wherein said roller has a diameter of approximately 190 mm, and said plurality of double rows comprise 90 double rows.

31. The apparatus of claim 30 wherein said adjacent pairs of lines are spaces apart approximately 1.27 mm.

32. A method of forming fibrillated polyolefin film material from an oriented film of unfibrillated polyolefin material by passing the material over a roller having a cylindrical surface and being adapted for rotation about its axis in a first direction, the method comprising the steps of:

providing said roller with a plurality of pins projecting from its cylindrical surface at an angle of from about 20 to about 80 degrees relative to a tangent of the roller directed opposite to said first direction, each pin havig a pin projection length in a range of from about 0.5 to about 2.0 mm and a diameter of from about 0.2 to about 0.8 mm, said plurality of pins being arranged in a pattern comprising a plurality of double rows spaced apart around the cylindrical surface, each double row having the pins distributed in a space staggered relationship along a pair of adjacent lines extending across the surface of said roller, wherein the adjacent pairs of lines of a double row are spaced a distance apart that is in the range of from 19% to 21% of the average distance between adjacent double rows;

rotating the roller about its axis at a controlled rate; and advancing the film at a first speed so that the film contacts the roller over an arc of from about 30 to about 37 degrees of the roller surface whereby the ratio of the surface speed of the roller in the direction of film advance to the first speed is from about 1.8:1 to about 2.2:1.

* * * * *